United States Patent [19]

Grimm

[11] Patent Number: 4,606,150

[45] Date of Patent: Aug. 19, 1986

[54] GRINDING MACHINE

[75] Inventor: Hans Grimm, Esslingen, Fed. Rep. of Germany

[73] Assignee: Maschinenfabrik Gehring Gesellschaft mit beschränkter Haftung & Co. Kommanditgesellschaft, Ostfildern, Fed. Rep. of Germany

[21] Appl. No.: 783,406

[22] Filed: Oct. 3, 1985

[30] Foreign Application Priority Data

Oct. 3, 1984 [DE] Fed. Rep. of Germany ..... 3436226

[51] Int. Cl.[4] ..... B24B 9/00

[52] U.S. Cl. ..... 51/34 C; 51/34 D; 51/35; 51/50 R; 51/290

[58] Field of Search ..... 51/34 C, 34 D, 34 H, 51/34 J, 166 TS, 166 FB, 33 R, 34 R, 33 W, 50 R, 165.93

[56] References Cited

U.S. PATENT DOCUMENTS 3,253,368 5/1966 Vekovios ..... 51/33 R 4,241,544 12/1980 Hampton ..... 51/33 R

*Primary Examiner*—Frederick R. Schmidt

*Assistant Examiner*—Maurina Rachuba

*Attorney, Agent, or Firm*—Becker & Becker, Inc.

[57] ABSTRACT

A grinding machine for machining the inner surfaces of workpieces. The machine has a bench to which are secured a workpiece headstock and a carriage which supports a grinder unit. The carriage can be moved on the bench via guides which are disposed on opposite sides of the grinder unit. Respective adjusting devices are provided for respectively pivoting a given one of the guides about an axis that is disposed at right angles to the axis of the grinder. The guides are formed by a circular guide and a roller guide arrangement which extend parallel to one another. The guides can be pivoted independently of one another to conform to the respective position of the workpiece axis, so that it is possible to achieve a precise alignment of the grinder axis relative to the workpiece axis, and at the same time to feed the tool against the wall of the bore which is to be machined. A very high machining precision is obtained in this way. Furthermore, the grinding machine is structurally straight forward.

25 Claims, 4 Drawing Figures

GRINDING MACHINE

BACKGROUND OF THE INVENTION

The present invention relates to a grinding machine for machining inner surfaces, especially cylindrical inner bores, of workpieces; the machine includes a base or bench, at least one headstock for workpieces, and a carriage that supports a grinder unit and is displaceably guided on the bench via guide means operatively connected thereto.

With heretofore known grinding machines of this type, the grinder unit, which rotatably drives the grinding tool, is supported by a cross slide that can be moved axially back and forth on longitudinal guides, and can be adjusted at right angles thereto by means of a transverse guide. A headstock is generally provided for holding the workpiece; a chuck for receiving the workpiece is rotatably supported in the headstock.

In order to obtain good results, very high requirements are set for the stability and precision of the guides; this, of course, involves correspondingly high structural and manufacturing expenses The roundness which can be achieved for the workpiece bore which is to be machined depends to a large extent upon how precisely the grinder axis can be aligned and guided relative to the axis of the workpiece. In this connection, prior to machining the workpiece bore, the guides must be manually aligned.

Errors which occur during the machining, and which are essentially caused by non-uniform abrasion of grinding material at the workpiece, is attempted to be kept within narrow limits by frequent adjustment or truing of the tool. However, this does not always produce satisfactory results. Furthermore, an additional drawback in each case is that the frequent truing process considerably reduces the service life of the tool; in addition, expensive grinding material is lost, especially when tools containing diamond or boron nitride grinding material are used.

It is an object of the present invention to provide a grinding machine of the aforementioned general type which, with a simple structure, permits a precise alignment of the grinder axis relative to the axis of the workpiece.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
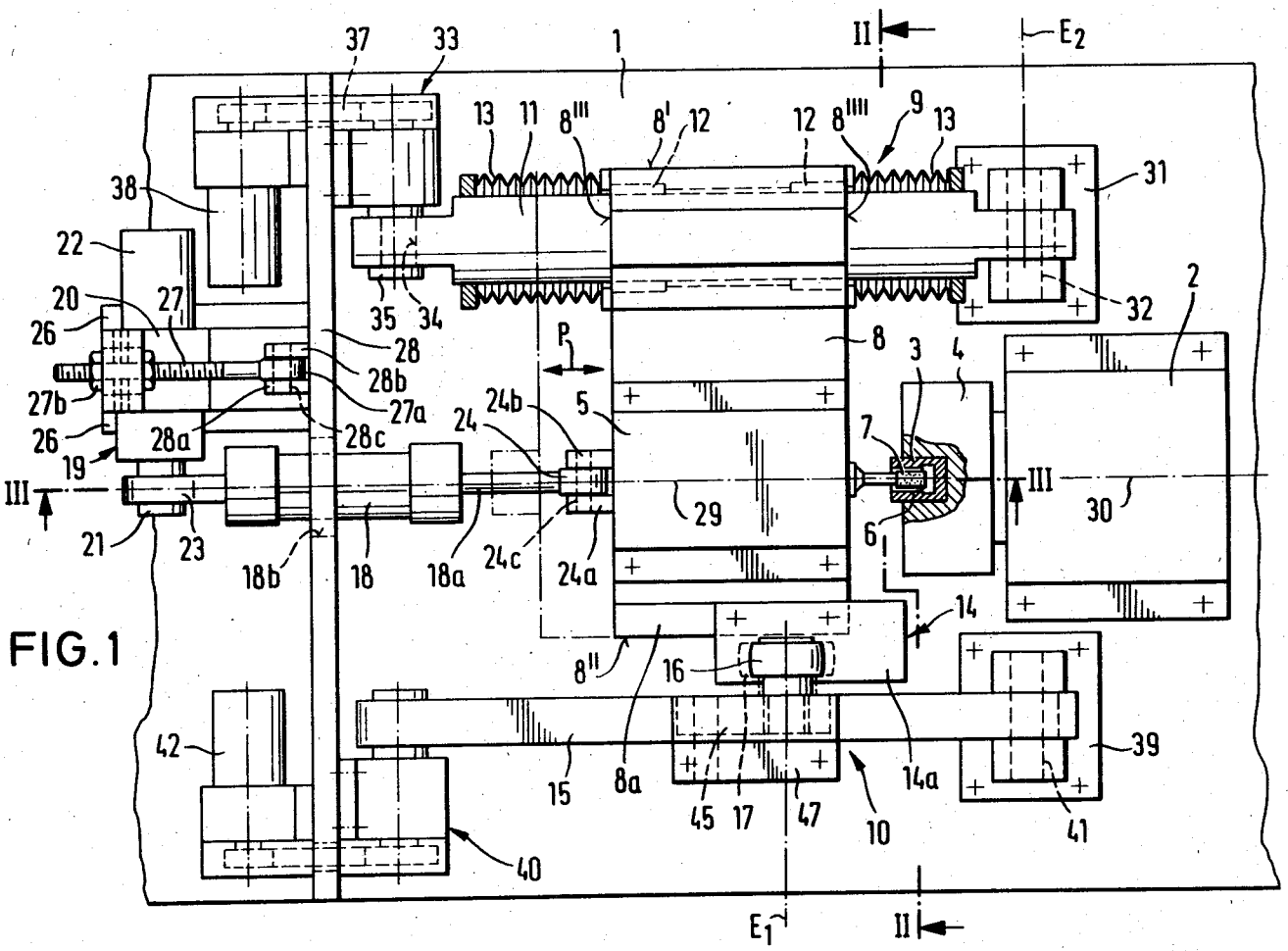
FIG. 1 is a schematic plan view of one inventive embodiment of a grinding machine.

The grinding machine of the present invention is characterized primarily in that the guide means are disposed on opposite sides of the headstock, with respective adjusting devices being provided for respectively pivoting a given one of the guide means about an axis that is disposed at right angles to the grinder axis.

As a consequence of the inventive construction, the heretofore known very expensive to produce longitudinal and transverse guides of the cross carriage guidance, which guides must be very precisely adapted to one another, are eliminated. In place thereof, separate guide means are provided which can be pivoted independently of one another to conform to the respective position of the workpiece axis. As a result, with the inventive grinding machine the alignment of the grinder axis relative to the axis of the workpiece can be adjusted in a simple manner and very precisely prior to, subsequent to, or during the machining; at the same time, the tool can be fed against the wall of the bore which is to be machined. A very high machining precission is thereby achieved. Furthermore, the tool needs to be trued much less frequently, so that the service life thereof can be significantly increased.

Further features of the present invention will be described subsequently.

DESCRIPTION OF PREFERRED EMBODIMENTS

Referring now to the drawings in detail, the grinding machine is used especially for machining workpieces having cylindrical inner bores. A headstock 2 is disposed on a base or bench 1 of the grinding machine, with a chuck 4 for a workpiece 3 being rotatably mounted in the headstock 2. The chuck 4 supports the workpiece 3, the cylindrical inner bore 6 of which is finely machined by a grinding tool 7.

The grinding tool 7 is driven at high speed by a known grinder unit 5. This unit is mounted, preferably being bolted, on a slide or carriage 8 which is mounted and driven in such a way that it can move axially back and forth (see arrow P in FIG. 1). In the region of its narrow sides 8' and 8'', the carriage 8 is supported on respective guide means 9 and 10. The guide means are formed by a circular guide 9, and a roller guide arrangement 10 which extends at a distance from and parallel to the guide 9. The circular guide 9, in a known manner, essentially comprises a round bar 11 which is mounted on the bench 1. The carriage 8 is axially displaceably guided on the round bar 11 via sliding or friction-bearing bushings 12. In order to protect the guide way, a covering is provided on both sides of the carriage 8, preferably one formed by a bellows 13. Disposed on the opposite side of the carriage 8 is the roller guide arrangement 10, which includes a guide rail 14 that is rigidly connected with the carriage. As shown in particular in FIG. 2, a vertical, upwardly directed edge portion **8*a* is provided on the carriage 8 in the vicinity of the guide rail 14**.

The guide rail 14 is secured at one end face in such a way that in the displacement direction P it projects beyond the longitudinal side 8'''' of the carriage 8 and beyond the edge portion **8*a*. By means of the projecting rail portion 10*a*, which extends in the displacement direction P, the guide rail 14, for guiding the carriage 8, extends between two support rollers 16 and 17 which are disposed vertically one above the other on the bench, and respectively have a spherical contact surface. The support rollers 16, 17 are mounted on a supporting arm 15 of the roller guide arrangement 10. The supporting arm 15 extends parallel to the round bar 11, and has approximately the same length. The support roller 16 is pressed against the guide rail 14 by a spring 44 (FIG. 2) in order to assure a guidance which is free of play. For this purpose, the support roller 16 is mounted on a bracket 45 that is pivotably connected to a vertically extending plate 46 that in turn is rigidly connected to the supporting arm 15. The spring 44 is supported on a horizontally extending transverse plate 47, which is preferably screwed to the upper end face of the plate 46**.

The carriage 8 is operated by a piston-cylinder unit 18 (FIGS. 1 and 2), and an oscillating drive 19 connected therewith; the oscillating drive 19 is formed by an eccentric drive. The arrangement is such that the grinding tool 7 can be inserted and withdrawn in a known manner into and from the bore 6 of the workpiece 3 by the piston-cylinder unit 18, and can then be vibrated back and forth within the bore 6 by the eccentric drive 19.

Figure 3:
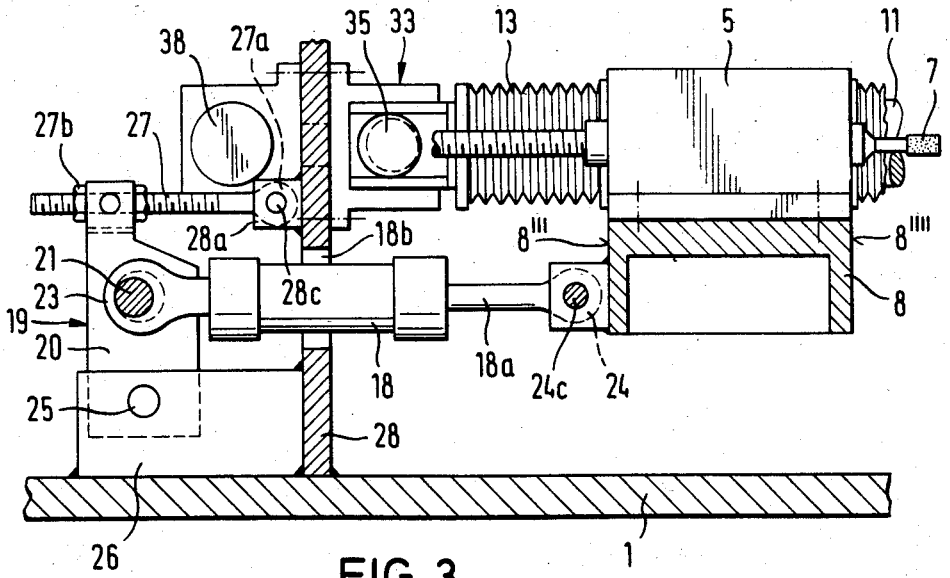
FIG. 3 is a partial sectional view taken along the line III—III in FIG. 1, omitting the workpiece and headstock.

The eccentric drive 19 is adjustably disposed on the carrier plate 20 on the bench 1. The eccentric drive 19 essentially comprises an eccentric shaft 21, the axis of which extends at right angles to the grinder axis 29; the shaft 21 is rotatably driven by a motor 22, for example an oil engine. The eccentric shaft 21 forms a bearing support upon which a support member 23 of the piston-cylinder unit 18, in the form of a so-called support eye, is mounted. The piston-cylinder unit 18 extends through an opening **18*b* (FIG. 3) of a vertical partition or support wall 28 of the bench 1. The inside diameter of the opening 18*b* is greater than the outer dimensions of the piston-cylinder unit 18, so that the latter can be pivoted relative to the partition 28**.

Figure 4:
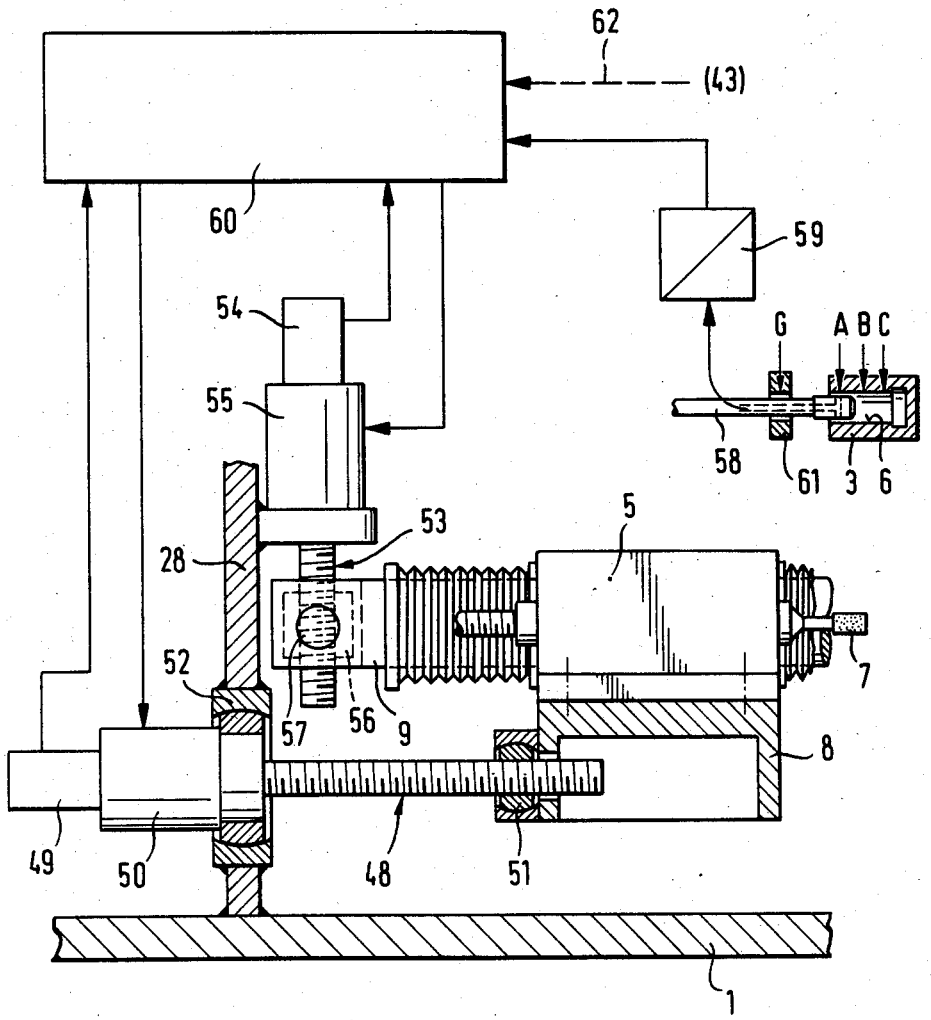
FIG. 4 shows an alternative drive arrangement for the carriage.

It is also advantageously possible, as illustrated in FIG. 4, to replace the eccentric drive with a known spherical thread drive 48 which is driven by a servomotor 50, the path of which is controlled by an angle coder 49 (NC-axis). It is particularly advantageous if the spherical thread drive 48, accompanied by the elimination of the piston-cylinder unit, is connected directly with the carriage 8 via a first Cardan or univeral joint 51, and is pivotably connected to the support wall 28 via a second Cardan or universal joint 52. In this way the arrangement is such that the grinding tool can be inserted into and withdrawn from the bore 6 of the workpiece by the spherical thread drive, and can be oscillated back and forth within the bore.

Figure 2:
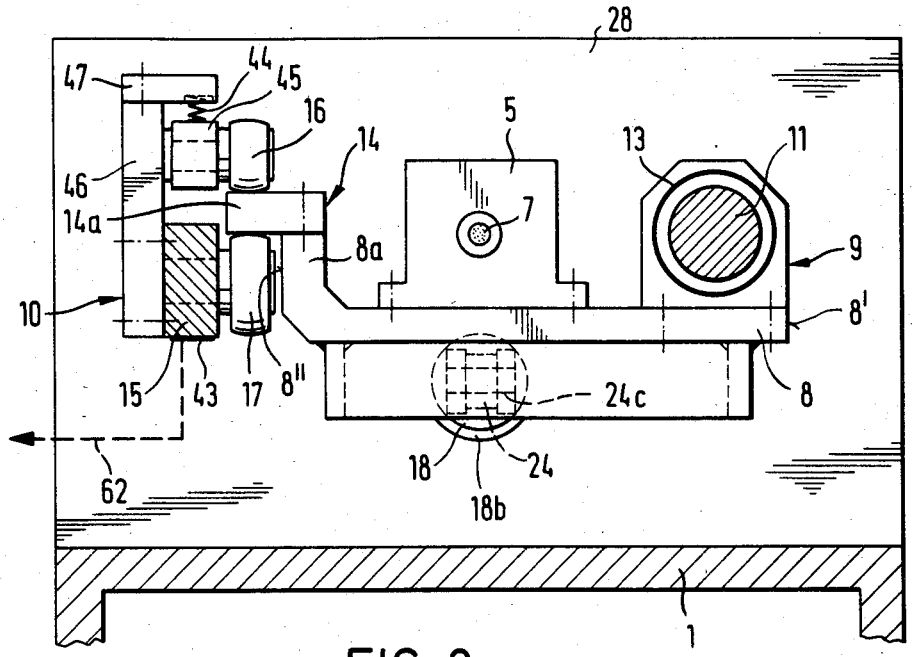
FIG. 2 is a section taken along the line II—II in FIG. 1.

That end 24 of the piston rod **18*a* of the piston-cylinder unit 18 opposite the eccentric drive 19 is in the form of an eye, and is pivotably connected with the carriage 8. For this purpose, as shown in FIGS. 1 and 2, the end 24 is disposed between two adjacent yet spaced apart brackets 24*a* and 24*b* that are mounted to the longitudinal side 8''' of the carriage 8. These brackets have insertion openings which are aligned with one another and with the opening of the end 24. In the assembled state, a joint pin 24*c*, which forms the pivot shaft for the piston rod 18*a***, is inserted through the aligned openings.

By shifting the carrier plate 20, the grinding tool 7 can be moved in the longitudinal direction within the workpiece bore 6. For this purpose, the carrier plate 20 is pivotably mounted by means of a pin 25 between two blocks 26 which are securely mounted to the bench 1; the carrier plate 20 is movably held by an adjusting screw 27 that is linked to the partition 28. The adjusting screw 27 is disposed adjacent to and above the piston-cylinder unit 18 on that side of the partition 28 remote from the circular guide 9, with an eye-like end **27*a* of the adjusting screw 27 (FIG. 3) extending between two holding brackets 28*a*, 28*b* of the partition 28; these holding brackets are disposed parallel to one another, and have openings which are aligned with the eye 27*a*, and through which a support pin 28*c* is inserted (FIG. 1). The carrier plate 20 is provided with a spindle nut 27*b* which is seated upon the adjusting screw 27, which in turn is pivotable relative to the carrier plate 20 about an axis disposed transverse to the grinder axis 29. Due to the pivotable mounting of the adjusting screw 27, when the carrier plate 20 pivots, the adjusting screw 27** can correspondingly pivot along upwardly or downwardly.

In order to adjust and alter the direction of the grinder axis 29 relative to the axis 30 of the workpiece, the circular guide 9 is adjustably supported and driven. For this purpose, that end of the round bar 11 which faces the headstock 2 is pivotably mounted on a bearing block 31 that is secured to the bench 1; in particular, this end of the round bar 11 is pivotable about a horizontal axis of rotation 32 that is disposed transverse to the grinder axis 29. The opposite end of the round bar 11 is held by an adjusting device 33 that is secured to the partition 28. By means of this adjusting device 33, the round bar 11 can be moved in the vertical direction about the axis of rotation 32.

The adjusting device 33 includes an eccentric shaft 35 that extends into a bearing bore 34 of the round bar 11, and is driven by a servomotor or stepping motor 38 via a drive member 37, such as friction wheels, gears, etc. In place of the eccentric adjustment, any other suitable adjusting means, such as a numerically controlled spherical thread drive 53 which is driven by a servomotor 55, the path of which is controlled by an angle coder 54 (NC-axis), can be used (FIG. 4).

The roller guide arrangement 10, which extends in a horizontal plane parallel to the circular guide 9, is also vertically adjustably mounted and driven via the supporting arm 15. For this purpose, that end of the supporting arm adjacent to the headstock 2 is, in the same manner as is the round bar 11, supported on the bench 1 in a bearing block 39, and is pivotably held, by an adjusting device 40, about a horizontal axis of rotation 41 of the bearing block 39 disposed transverse to the grinder axis 29; furthermore, the supporting arm 15 is driven by a servomotor or stepping motor 42. In this way, the grinder axis 29 can be moved in the vertical direction (vertical position) relative to the axis 30 of the workpiece, thus in a simple manner forming a vertical feed device for the grinding tool 7. The adjusting device 40 and the motor 42 are mounted directly on the bench 1 or on the partition 28 as are the adjusting device 33 and the motor 38.

The adjustment arrangement for the circular guide 9 and the roller guide arrangement 10 is preferably such that the grinding tool 7, which is in engagement within the bore 6, is disposed halfway between two vertical planes $E_1$, $E_2$ which extend at right angles to the displacement direction P, and which contain the line of contact of the support roller 17 with the guide rail 14, and the axis of rotation 32 of the bearing block 31 respectively. By means of this arrangement, when the circular guide 9 is adjusted via the adjusting device 33, only the direction of the grinder axis 29, but not its vertical height relative to the axis 30 of the workpiece is changed. The vertical position, i.e. the vertical feed of the grinding tool 7, is effected exclusively by adjusting the supporting arm 15 of the roller guide arrangement 10 via the adjusting device 40.

It is, of course, to be understood that the aforementioned relationships of the adjusting arrangement can be altered from case to case, so that, for example, the grinding tool 7 is not disposed centrally between the planes $E_1$ and $E_2$. In these cases, an adjustment of the circular guide 9 by means of the adjusting device 33 effects not only a change of the direction of the grinder axis, but also a change of its vertical position relative to the axis of the workpiece.

By means of a simultaneous adjustment of the roller guide arrangement 10 with the adjusting device 40, the vertical adjustment of the grinder axis can be avoided, i.e. the adjustment can be corrected to the extent desired for the vertical feed of the grinding tool. The adjustment of the guides 9 or 10 is preferably controlled by measurement, so that the grinder axis 29 can be automatically adjusted. For this purpose, a known, for example pneumatic, measuring device 58 measures the deviation of the workpiece bore 6 from the desired shape, for example that of a cylinder, and from the desired size, for example in the planes A, B, and C. These measurements can take place during rest periods or subsequent to the grinding. The measured values are fed in suitable form via a measurement transformer 59 to an electronic evaluation and computing unit 60. If the measurements from the measurement planes A, B, and C deviate from the permissible tolerance, the servomotors or stepping motors 38, 42, 50, 55 are appropriately activated, whereupon via the adjustment devices 33 or 40 they adjust the guides 9 and 10 until the desired size is obtained. The evaluating and computing unit 60 then emits a signal, as a result of which the grinding process is terminated. Thus, by comparing the actual and desired values, and by an appropriate adjustment of the guide 9 and/or the guide 10, the grinding process can take place and can terminate automatically.

So that no measurement shifts can occur in this system, a setting ring 61 can monitor the system after every measurement process. For this purpose, the measuring device measures in the measurement plane G of the setting ring 61, with the measurement plane G corresponding to the desired dimension of the workpiece bore. The indicated actual measurement is then compared with the desired size, and if necessary is corrected.

Furthermore, the progress of the grinding can be automatically controlled by a device which indirectly measures the grinding force. For this purpose, by means of a suitable indicator, preferably a strain gauge 43, the deflection of the supporting arm 15, caused by the bearing load of the carriage 8 upon the support roller 17, is measured. This deflection is a measure for the bearing load of the carriage 8, and for the degree of wear of the tool 7. The strain gauge 43 is preferably disposed at the location of greatest deflection, i.e. at the level of the support roller 17, on the underside of the supporting arm 15 (FIG. 2). The continuously measured values are fed via a line or connection 62 to the known electronic computing and control device 60 (FIG. 4). The measured values are utilized for computing the adjustment of the guides 9, 10, so that the latter can be adjusted while taking into consideration the wear of the tool 7. The grinding process is controlled by the computing and control device 60 in such a way that optimum grinding is accomplished, and adjustment at the grinding tool 7 can be reduced to the necessary extent.

The present invention is, of course, in no way restricted to the specific disclosure of the specification and drawings, but also encompasses any modifications within the scope of the appended claims.

What is claim is:

1. A grinding machine for machining inner surfaces of workpieces; said machine includes a bench, at least one headstock, for workpieces, connected to said bench, and a carriage that supports a grinder unit and is displaceably guided on said bench via guide means operatively connected to the latter, with said grinder unit having an axis about which a grinding tool thereof rotates;

the improvement wherein said guide means are disposed on opposite sides of said grinder unit, and wherein respective adjusting devices are provided for respectively pivoting a given one of said guide means about an axis that is disposed at right angles to said axis of said grinder unit.

2. A grinding machine according to claim 1, in which one of said guide means is a circular guide, and the other of said guide means is a roller guide arrangement, with said circular guide and said roller guide arrangement extending parallel to one another.

3. A grinding machine according to claim 2, in which said circular guide and said roller guide arrangement also extend parallel to said axis of said grinder unit.

4. A grinding machine according to claim 3, which includes an upper and a lower support roller which are vertically spaced one above the other on said bench; and in which said roller guide arrangement includes a guide rail that is rigidly connected to said carriage and is movably guided between said support rollers.

5. A grinding machine according to claim 4, which includes a supporting arm that is pivotably disposed on said bench, with said support rollers in turn being supported by said supporting arm.

6. A grinding machine according to claim 5, which includes a bearing block connected to said bench, with said supporting arm being pivotably mounted in said bearing block in such a way as to be pivotable about an approximately horizontal axis that is disposed at right angles to said axis of said grinder unit.

7. A grinding machine according to claim 6, in which said supporting arm is adjustably connected to one of said adjusting devices.

8. A grinding machine according to claim 7, in which said adjusting device for said supporting arm includes a motor-driven eccentric shaft that is disposed at right angles to said axis of said grinder unit, with an end of said supporting arm, remote from said bearing block, being pivotably mounted on said eccentric shaft.

9. A grinding machine according to claim 8, in which said adjusting device for said supporting arm is formed by a numerically controlled spherical thread drive (NC-shaft).

10. A grinding machine according to claim 8, in which one of said support rollers rests upon said guide rail under spring tension.

11. A grinding machine according to claim 10, which includes an approximately vertical plate that is rigidly connected to said supporting arm, with one of said support rollers being pivotably connected to said plate.

12. A grinding machine according to claim 4, in which said carriage is operatively connected with an oscillating drive.

13. A grinding machine according to claim 12, which includes a piston-cylinder unit interposed between said oscillating drive and said carriage to effect said operative connection therebetween.

14. A grinding machine according to claim 13, in which said oscillating drive is formed by an eccentric drive.

15. A grinding machine according to claim 13, in which said oscillating drive is formed by a numerically controlled spherical thread drive (NC-shaft).

16. A grinding machine according to claim 13, in which said oscillating drive includes a shaft, and in which said piston-cylinder unit has two ends, one of which is seated on said shaft of said oscillating drive, and the other of which is pivotably connected to said carriage.

17. A grinding machine according to claim 16, which includes a carrier plate that is pivotably mounted relative to said bench; and in which said shaft of said oscillating drive extends approximately at right angles to said axis of said grinder unit, and is held in said carrier plate.

18. A grinding machine according to claim 17, in which said bench includes an approximately vertical partition; and which includes an adjusting member, linked to said partition, for adjusting said carrier plate.

19. A grinding machine according to claim 4, which includes a bearing block connected to said bench; and in which said circular guide includes a round bar having two ends, one of which is remote from said headstock and is operatively connected to said bench, and the other of which faces said headstock and is pivotably mounted in said bearing block in such a way as to be pivotable about an approximately horizontal axis.

20. A grinding machine according to claim 19, in which said bench includes an approximately vertical partition, and in which said round bar is adjustably connected to one of said adjusting devices, which in turn is mounted to said partition.

21. A grinding machine according to claim 20, in which said adjusting device for said round bar includes a motor-driven eccentric shaft that is disposed at right angles to said axis of said grinder unit, with that end of said round bar remote from said headstock being pivotably connected to said eccentric shaft.

22. A grinding machine according to claim 21, in which said adjusting device for said round bar is formed by a numerically controlled spherical thread drive (NC-shaft).

23. A grinding machine according to claim 4, in which said grinding tool is spaced approximately equally from two approximately vertical planes that extend at right angles to the direction of displacement of said carriage; one of said planes contains a line denoting contact between said lower support roller and said guide rail, and the other of said planes contains said pivot axis for said circular guide.

24. A grinding machine according to claim 4, which includes a desired-actual-value comparator and control unit operatively connected to said adjusting devices for said guide means for regulating said adjusting devices in conformity with differences between desired values for said workpiece, and actual values of the latter.

25. A grinding machine according to claim 24, which includes a supporting arm that supports said support rollers and is pivotably disposed on said bench; and which includes a measurement transmitter disposed on said supporting arm and connected to an electronic calculating and/or control device having an output which is connected to an input of said comparator and control unit.

* * * * *